US010332675B2

(12) United States Patent
Esakki et al.

(10) Patent No.: US 10,332,675 B2
(45) Date of Patent: Jun. 25, 2019

(54) LINEAR VARIABLE DISPLACEMENT TRANSFORMER (LVDT) WITH IMPROVED SENSITIVITY AND LINEARITY USING FRACTIONAL WINDING TECHNIQUE

(71) Applicant: Honeywell International Inc., Morris Plains, NJ (US)

(72) Inventors: Subramanian Esakki, Bangalore (IN); Keshava Prasad, Bangalore (IN); Vijayshekhar Araganji, Bangalore (IN); Aaron Daniels, Echo, MI (US); John Jerred, East Jordan, MI (US)

(73) Assignee: Honeywell International Inc., Morris Plains, NJ (US)

( * ) Notice: Subject to any disclaimer, the term of this patent is extended or adjusted under 35 U.S.C. 154(b) by 145 days.

(21) Appl. No.: 15/401,879

(22) Filed: Jan. 9, 2017

(65) Prior Publication Data

US 2018/0197677 A1 Jul. 12, 2018

(51) Int. Cl.

| | |
|---|---|
| ***H01F 21/06*** | (2006.01) |
| ***H01F 29/10*** | (2006.01) |
| ***H01F 27/28*** | (2006.01) |
| ***H01F 27/32*** | (2006.01) |

(52) U.S. Cl.

CPC ..... *H01F 29/10* (2013.01); *H01F 27/2823* (2013.01); *H01F 27/325* (2013.01)

(58) Field of Classification Search

CPC ..... H01F 29/10; H01F 27/325; H01F 27/2823

USPC ..... 336/130–132

See application file for complete search history.

(56) References Cited

U.S. PATENT DOCUMENTS

| | | | | |
|---|---|---|---|---|
| 3,054,976 | A | 9/1962 | Lipshutz | |
| 4,808,958 | A * | 2/1989 | Hewitt | G01D 5/2291 336/136 |
| 7,317,371 | B1 * | 1/2008 | Carroll | G01D 5/2291 336/130 |
| 2008/0278149 | A1 * | 11/2008 | Gualtieri | G01D 5/2073 324/207.17 |
| 2016/0033306 | A1 * | 2/2016 | Hubbell | G01D 5/2291 244/76 R |

* cited by examiner

*Primary Examiner* — Ronald Hinson

(74) *Attorney, Agent, or Firm* — Craige Thompson; Thompson Patent Law

(57) ABSTRACT

Embodiments generally relate to linear variable displacement transformer (LVDT) position sensors. The position sensor comprises a bobbin, a moveable core, a primary coil of wire wound around the bobbin, and two secondary coils of wire wound around the bobbin about the primary coil using a fractional winding technique. For example, the winding length of the bobbin may be separated into three consecutive parts. Generally, the primary coil may be wound around the entire winding length of the bobbin. The first secondary coil may be wound around the first and second parts of the winding length. The second secondary coil may be wound around the second and third parts of the winding length. Additionally, the first secondary coil and the second secondary coil may overlap over the second part of the winding length.

19 Claims, 6 Drawing Sheets

LINEAR VARIABLE DISPLACEMENT TRANSFORMER (LVDT) WITH IMPROVED SENSITIVITY AND LINEARITY USING FRACTIONAL WINDING TECHNIQUE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD

Embodiments generally relate to electromechanical devices and, more specifically, to linear variable displacement transformers (LVDTs) for measurement of movement and linear displacement/position of externally coupled objects used in various applications (for example aerospace, hydraulics, automation, power turbines, satellites, etc.).

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
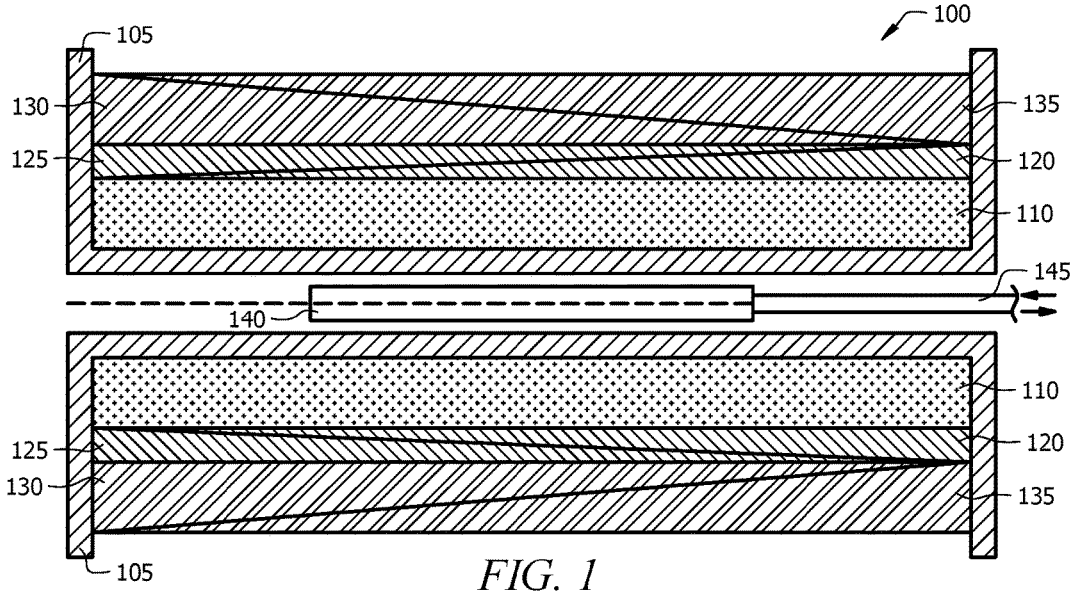
FIG. 1 illustrates a cross-sectional view of an exemplary embodiment of a linear variable displacement transformer (LVDT) comprising one primary coil winding, two tuning coil windings, and two secondary coil windings wound around a bobbin.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field (for example, +/−10%); and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

The embodiments of this disclosure typically relate to electromechanical devices such as linear variable displacement transformers (LVDTs) used to determine movement and linear displacement/position of externally coupled objects used in various applications, for example aerospace (e.g. flight control stabilization, fuel control in engine valves, etc.), hydraulics (e.g. control clearance of valves, etc.), power turbines, nuclear reactors, satellites, automation, etc. Conventionally, LVDTs may comprise a bobbin, a moveable core, a primary coil winding, and two secondary coil windings. The bobbin may be cylindrical and comprise an axial bore to fit the moveable core. The moveable core may be fit within the axial bore in a manner such that the moveable core does not interface with the axial bore (e.g. to allow the LVDT to be inherently frictionless) and may be free to move linearly/longitudinally along the common axis of the primary coil windings and the two secondary coil windings. In some embodiments, the moveable core may be attached to one or more rods or coupling devices. In some embodiments, the rod(s) may be coupled to the moveable core. In some embodiments, the rod(s) may extend from either end of the bobbin. Additionally, in some embodiments, the moveable core may comprise ferromagnetic materials (e.g. alloys of iron, nickel, cobalt manganese, chromium, molybdenum, permalloy, mu-metal, or combinations thereof). Alternatively, the moveable core may comprise non-ferrous metal. In other embodiments, the moveable core may comprise permalloy or mu-metal. Generally, the primary coil winding and the two secondary coil windings are wound around the outside (e.g. exterior surface) of the bobbin. In some embodiments, the primary coil is wound around the center of the bobbin while the two secondary coils are disposed adjacent to the primary coil. In some embodiments, the primary coil winding and the two secondary coil windings may be oriented in a different manner (for example, the two secondary coil windings wound around the primary coil winding and oriented such that the first secondary coil winding is tapered and/or stepped complimentary to the second secondary coil winding). In this manner, when the primary coil winding may be electrically excited with an excitation signal, the two secondary coil windings may be inductively coupled to the primary coil winding. As the moveable core moves in one direction or another (e.g. left or right), the coupling from the primary coil winding to the secondary coil windings may change, and an indication (e.g. electrical signal) of the position of the coupled object is provided by the outputs of the secondary coil windings. Persons of skill should appreciate other techniques of winding the primary coils and the secondary coils around the bobbin to ultimately determine the position of the object coupled to the LVDT. Generally, the primary coil winding and the secondary coil winding(s) may be symmetric with respect to the center of the bobbin (for example, the first secondary coil winding and the second secondary coil winding may be mirrored (e.g. across the longitudinal axis of the bobbin)).

Disclosed embodiments relate to a LVDT. Typically, important characteristics of a practical LVDT may include the need to be small and compact as well as accurate with a low cost of manufacture. Additionally, for some applications, LVDTs may need to be configured to have a short stroke (for example, ±0.05 inches to 0.20 inches), shorter form factor/lesser packaging size, lower weight, improved sensitivity, improved linearity (e.g. providing a highly linear output signal over the range of displacement), improved output gain, and lower part to part variation. Typically, LVDTs may achieve some of the described characteristics at the cost/sacrifice of other necessary characteristics (e.g. linearity, sensitivity, accuracy, etc.). Disclosed herein are embodiments that achieve an improvement in linearity and sensitivity of the measurements obtained by the LVDT.

In some embodiments, the conventional LVDT (comprising one primary coil and two secondary coils) may further comprise two tuning coil windings. Typically, the primary coil may be wound around a pre-defined winding length of the bobbin. The two tuning coil windings may be wound on top of the primary coil. For example, the first tuning coil may be wound from one end of the winding length to the other end of the winding length in a tapering manner (e.g. with the most number of turns of coil near one end of the winding length and the least number of turns of coil near the other end of the winding length) with variable pitch winding (e.g. with the distance between the coils continuously increasing while moving from the end of the winding length having the most number of turns to the end of the winding length having the least number of turns), and the second tuning coil may be wound in a complimentary fashion to the first tuning coil (e.g. in a manner such that the first tuning coil and the second tuning coil achieve a constant/uniform outer diameter around the bobbin) (e.g. in a manner such that the cross-sectional interface between the two tuning coil windings is approximately linear). In some embodiments, the two secondary coils may be wound around the two tuning coil windings. For example, the first secondary coil may be wound from one end of the winding length to the other end of the winding length in a tapering manner (e.g. with the most number of turns of coil near one end of the winding length and the least number of turns of coil near the other end of the winding length) with variable pitch winding (e.g. with the distance between the coils continuously increasing while moving from the end of the winding length having the most number of turns to the end of the winding length having the least number of turns), and the second secondary coil may be wound in a complimentary fashion to the first secondary coil (e.g. in a manner such that the first secondary coil and the second secondary coil achieve a constant/uniform outer diameter around the bobbin) (e.g. in a manner such that the cross-sectional interface between the two secondary coils is approximately linear). Alternatively, in some embodiments, the two tuning coil windings and the two secondary coils may comprise uniform pitch winding. In other words, the distance between the coils may remain constant/consistent across the winding length of the bobbin.

In the embodiment described above, the addition of the two tuning coil windings (e.g. wound crisscross over the primary coil) may improve the gain of the LVDT, thereby improving the sensitivity of the LVDT. Typically, gain may be limited by the winding slope and/or the ratio between the number of turns of the primary coil and the number of turns of the secondary coils. In some embodiments, by adding tuning coil windings, the winding slope may be increased leading to improved sensitivity. While the overall sensitivity of the LVDT with the tuning coil windings may be improved, the addition of two tuning coil windings increases the outer diameter (OD) of the LVDT. This increase in the outer diameter may lead to greater form factor/packaging size, higher weight, higher part to part variation (e.g. with the addition of two tuning coil windings), higher time/cost to manufacture (e.g. manufacturing and oppositely winding the tuning coil windings), etc. Additionally, in some embodiments, the addition of two tuning coil windings may decrease the sum voltage (e.g. the addition of one layer of tune winding may be equivalent to the addition of two layers of secondary windings). Additionally, although the overall sensitivity of the LVDT may be improved by increasing the gain, there may be a higher variation in the sensitivity (e.g. variation in sensitivity between simulation results and test/experimental results) due to higher part to part variation. Typically, the addition of tuning coil windings may be difficult to implement since the tuning coil windings may be wound opposite to the secondary coil windings leading to higher chances of operator error and greater processing time. To address these drawbacks, an LVDT device is described herein that improves linearity and sensitivity (e.g. in comparison to conventional LVDT devices) without the addition of tuning coil windings.

Embodiments of the disclosure include a LVDT device comprising one primary coil winding and two secondary coil windings wound/wrapped around the bobbin using a fractional winding technique. Typically, the primary coil winding may, for example, be wound/wrapped (e.g. uniformly) around the total winding length of the bobbin. Typically, the secondary coil windings may be wound/wrapped around/on top of at least a portion of the primary coil. As previously discussed, the sensitivity of the LVDT may depend on the winding slope. Typically, to increase the sensitivity of the LVDT, the secondary coils may be wound as a pre-determined/pre-defined percentage of the total winding length. In some embodiments, the winding length of the bobbin may be split into three winding lengths: a first winding length, a second winding length, and a third winding length. Typically, the first winding length of the bobbin may be located on one end of the bobbin while the third winding length of the bobbin may be located on the other (e.g. opposite) end of the bobbin. Additionally, the first winding length of the bobbin and the third winding length of the bobbin may be equal in length and form a pre-determined/pre-defined percentage of the total winding length (e.g. the first winding length and the third winding length each being approximately 5%, 10%, 15%, 20/%, 25%, 30%, etc. of the total winding length). Typically, the second winding length of the bobbin may be the winding length between the first winding length of the bobbin and the third winding length of the bobbin. In some embodiments, the second winding length of the bobbin comprises the first secondary coil and the second secondary coil (e.g. the first secondary coil and the second secondary coil overlap at a cross-sectional interface (typically, the cross-sectional interface may occur at a pre-determined/pre-defined winding slope)). Generally, determination of the pre-determined/pre-defined winding slope may depend on the preferred sensitivity (which varies based on application) of the LVDT.

In some embodiments, the first secondary coil may be (continuously) wound across the first winding length and the second winding length of the bobbin. Typically, the first secondary coil may be wound to an equal outer diameter for the first winding length of the bobbin (e.g. an equal number of turns of coil across the first winding length). In some embodiments, the first winding length of the bobbin may not comprise the second secondary coil. Generally, for the second winding length of the bobbin, the first secondary coil may be wound in a tapering manner (e.g. the number of turns of the first secondary coil may proportionally decrease going from one end (e.g. closest to the first winding length) of the second winding length to the other end (e.g. closest to the third winding length) of the second winding length). In other words, the outer diameter of the first secondary coil may decrease across (e.g. from the end closest to the first winding length to the end closest to the third winding length) the second winding length. Additionally, in some embodiments, the first secondary coil may be wound with variable pitch windings (e.g. the distance between the turns of first secondary coils may vary (e.g. non-uniform)). In other words, the distance between the turns of the first secondary coil may increase as the first secondary coil becomes more tapered. Additionally, it is important to note that the first secondary coil may comprise a continuous conductive wire (e.g. the first secondary coil may be wound from the first winding length of the bobbin to the second winding length of the bobbin (or vice versa) with one continuous wire).

In some embodiments, the second secondary coil may be wound in a similar manner to the first secondary coil. However, the second secondary coil may be wound in the opposite direction to the first secondary coil. Typically, for the third winding length of the bobbin, the second secondary coil may be wound to an equal outer diameter (e.g. an equal number of turns of coil across the third winding length). Additionally, within the third winding length of the bobbin, only the second secondary coil may be wound around the primary coil (in other words, the third winding length of the bobbin may not comprise the first secondary coil). Generally, for the second winding length of the bobbin, the second secondary coil may be wound in a tapering manner (e.g. the number of turns of the second secondary coil may proportionally decrease going from one end (e.g. closest to the third winding length) of the second winding length to the other end (e.g. closest to the first winding length) of the second winding length). Additionally, in some embodiments, the second secondary coil may be wound with variable pitch windings (e.g. the distance between the turns of the second secondary coil may vary (e.g. non-uniform)). In other words, the distance between the turns of the second secondary coil may increase as the second secondary coil becomes more tapered. Generally, the second secondary coil may complement and be coiled in the opposite direction to the first secondary coil (to maintain the symmetrical nature of the LVDT; in other words, to keep the "null point" (i.e. the zero output voltage point) of the core to be physically centered). Typically, in the second winding length of the bobbin, the second secondary coil may interface with the first secondary coil winding but not the primary coil winding (leading to a symmetric (e.g. about the longitudinal axis of the bobbin) winding pattern). Additionally, it is important to note that the second secondary coil may comprise a continuous conductive wire. In other words, the second secondary coil may be wound from the third winding length of the bobbin to the second winding length of the bobbin (or vice versa) with one continuous wire.

In some embodiments, there may be a correlation relating the winding slope, the winding length, first segment pitch, coil diameter, and sensitivity. As discussed previously, to improve the sensitivity and linearity of the LVDT, the winding slope may need to be increased. In some embodiments, the winding slope may be determined using the following equation:

$$M_W=1/(Y_F*L) \tag{1}$$

where $M_W$ represents the winding slope, $Y_F$ represents the first segment pitch of the secondary coil windings, and L represents the winding length (e.g. the first winding length plus the second winding length plus the third winding length). In some embodiments, when the tweak (e.g. the distance between the first two turns of the secondary windings) is zero, the first segment pitch of the secondary windings ($Y_F$) may equal the maximum secondary coil diameter ($D_M$). In this manner, Eq. 1 may be simplified to the following equation:

$$M_{W,max}=1/(D_M*L) \tag{2}$$

As mentioned previously, the winding slope (Mw) may be proportional to the sensitivity (S) of the LVDT. Thus, the following relationship results:

$$S=k*M_W \tag{3}$$

By substituting Eq. 3 into Eq. 2, the following equation relating sensitivity (S), maximum secondary coil diameter ($D_M$), winding length (L), and drive constant (k) results:

$$S=k/(D_M*L) \tag{4}$$

In some embodiments, the user may rearrange Eq. 4 to solve for the total winding length (L).

$$L=k/(D_M*S) \tag{5}$$

Typically, the total winding length (L) (e.g. minimum winding length) may be found from summing the length of the moveable core and the full-scale stroke of the moveable core. Typically, the length of the moveable core may be determined by a combination of impedance, secondary coil's outer diameter, power factor (PF), and phase shift.

In some embodiments, depending on the application, the user may use a required sensitivity to calculate a target winding length (e.g. target secondary winding length). Typically, the target winding length may be the sum of the first winding length and the second winding length and/or the sum of the second winding length and the third winding length. The following equation results from re-defining the terms of Eq. 5:

$$L_T=k/(D_M*S_T) \tag{6}$$

where $L_T$ represents the target secondary winding length and $S_T$ represents the target sensitivity. Depending on the application, $S_T$, k, and $D_M$ may be pre-defined/pre-determined and/or found from testing (e.g. performing calibration tests).

Typically, for high sensitivity applications, the winding length may be less than the winding space available between two magnetic washers (e.g located on either end of the bobbin). Typically, for high stroke applications, the required winding length may be high. Generally, the total winding length (L) may be greater than the target secondary winding length ($L_T$). Additionally, in some embodiments, by subtracting the target secondary winding length ($L_T$) from the total winding length (L), the user may determine the first winding length of the bobbin and the third winding length of the bobbin.

Typically, the fractional winding technique discussed above may reduce the packaging diameter, winding complexity, weight, process time, part to part variation, and operator error. Additionally, due to less part to part variation, there may be fewer tracking errors. In other words, there may be greater linearity between the results obtained from LVDTs within, for example, multi-channel LVDTs. Typically, this may prevent the user from calibrating the LVDT to, for example, correct for error in sensitivity. Additionally, there may be greater correlation between simulation results and test/experimental results using the LVDT. While persons of skill should understand the disclosed embodiments based on the above disclosure, the following figures may provide specific examples that may further clarify the disclosure.

Turning now to the drawings, FIG. 1 illustrates a cross-sectional view of an exemplary embodiment of a linear variable displacement transformer (LVDT) 100 comprising one primary coil winding 110, two tuning coil windings 120, 125, and two secondary coil windings 130, 135 wound around a bobbin 105. Typically, the primary coil winding 110, the tuning coil windings 120, 125, and the secondary coil windings 130, 135 may surround/enclose the bobbin 105. In the embodiment of FIG. 1, the interior of the bobbin 105 comprises a moveable core 140. In some embodiments, the interior of the bobbin 105 may be plated with metal, such as nickel. Additionally, the moveable core 140 may comprise ferromagnetic materials (e.g. alloys of iron, nickel, cobalt, manganese, chromium, molybdenum, permalloy, mu-metal, or combinations thereof), non-ferrous materials, permalloy, and/or mu-metal. In the exemplary embodiment shown in FIG. 1, the moveable core 140 is attached to a rod 145. In some embodiments, there may be one or more rods 145 which may thread into the moveable core 140. In some embodiments, the rod(s) 145 may extend from either end of the bobbin 105. As shown in the exemplary embodiment of FIG. 1, the primary coil winding 110 is wound around the length of the bobbin 105. The two tuning coil windings 120, 125 are wound on top of the primary coil winding 110. In the embodiment of FIG. 1, the first tuning coil winding 120 is wound from one end of the winding length to the other end of the winding length (e.g. on top of at least a portion of the primary coil winding 110) in a tapering manner (e.g. with the most number of turns of coil near one end of the winding length and the least number of turns of coil near the other end of the winding length), and the second tuning coil 125 is wound in a similar but complementary manner (e.g. opposite direction) to the first tuning coil 120 (e.g. in a manner such that the first tuning coil 120 and the second tuning coil 125 achieve a constant/uniform outer diameter around the bobbin 105) (e.g. in a manner such that the cross-sectional interface between the two tuning coil windings 120, 125 is approximately linear). Additionally, in the embodiment of FIG. 1, the tuning coil windings 120, 125 comprise variable pitch winding (e.g. with the distance between the coils continuously increasing while moving from the end of the winding length having the most number of turns to the end of the winding length having the least number of turns). Also shown in the embodiment of FIG. 1, the two secondary coils 130, 135 may be wound around the two tuning coil windings 120, 125. In the exemplary embodiment of FIG. 1, the first secondary coil 130 is wound from one end of the winding length to the other end of the winding length in a tapering manner (e.g. with the most number of turns of coil near one end of the winding length and the least number of turns of coil near the other end of the winding length) with variable pitch winding (e.g. with the distance between the coils continuously increasing while moving from the end of the winding length having the most number of turns to the end of the winding length having the least number of turns), and the second secondary coil 135 may be wound in a complimentary fashion (e.g. opposite direction) to the first secondary coil 130 (e.g. in a manner such that the first secondary coil 130 and the second secondary coil 135 achieve a constant/uniform outer diameter around the bobbin 105) (e.g. in a manner such that the cross-sectional interface between the two secondary coils 130, 135 is approximately linear).

In the exemplary embodiment shown in FIG. 1, the first tuning coil winding 120 tapers in the opposite direction to the second tuning coil winding 125, and the first secondary coil winding 130 tapers in the opposite direction to the second secondary coil winding 135. Typically, the two tuning coil windings 120, 125 and the two secondary coil windings 130, 135 each comprise a plurality of steps. Typically, each step comprises a varying number of turns of coil. In some embodiments (as shown in the exemplary embodiment of FIG. 1), the number of turns of coil proportionally decrease from one end of the winding length to the other end of the winding length. In some embodiments, the number of turns of coil within each step may decrease monotonically and/or may differ by a constant value (e.g. constant delta). Generally, the primary coil winding 110, the tuning coil winding(s) 120, 125, and the secondary coil winding(s) 130, 135 may be symmetric (e.g. mirrored) with respect to the longitudinal axis of the bobbin 105 as shown in the exemplary embodiment of FIG. 1.

Figure 2A:
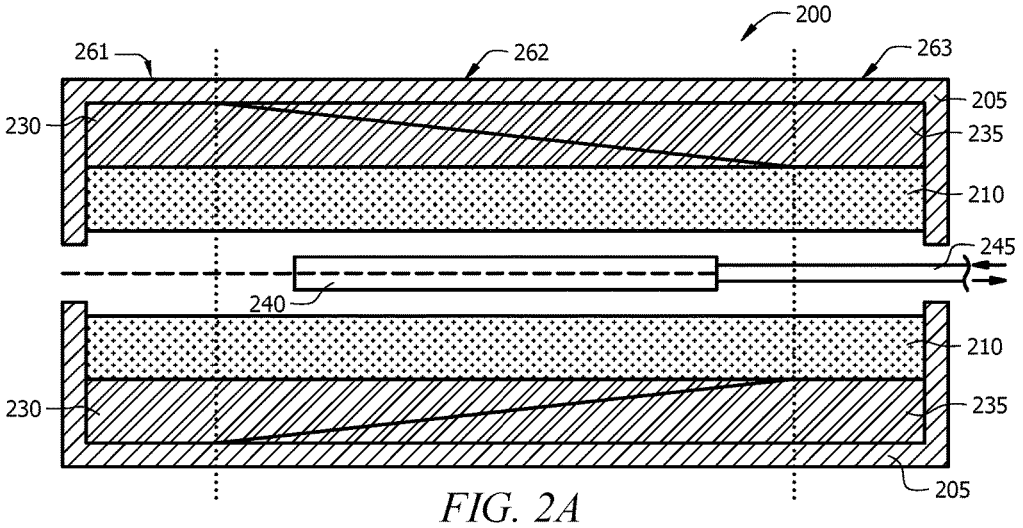
FIG. 2A illustrates a cross-sectional view of an exemplary embodiment of a LVDT comprising one primary coil winding and two secondary coil windings wound around a bobbin.

FIG. 2A illustrates a cross-sectional view of an exemplary embodiment of a LVDT 200 comprising one primary coil winding 210 and two secondary coil windings 230, 235 wound around a bobbin 205 using a fractional winding technique. In the embodiment of FIG. 2A, the moveable core 240 and the bobbin 205 function similar to the ones described in reference to the exemplary embodiment of FIG. 1. In the embodiment of FIG. 2A, the winding length of the bobbin 205 may be split into three winding lengths 261, 262, 263. Typically, the first winding length 261 may be located on one end (e.g. left) of the bobbin 205 while the third winding length 263 may be located on the other end (e.g. right) of the bobbin 205. Additionally, the first winding length 261 and the third winding length 263 may be equal in length and form a pre-determined/pre-defined percentage of the total winding length (e.g. the first winding length 261 and the third winding length 263 each being approximately 5%, 10%, 15%, 20%, 25%, 30%, etc. of the total winding length). Typically, the second winding length 262 may be located between the first winding length 261 and the third winding length 263. In the exemplary embodiment of FIG. 2A, the second winding length 262 of the bobbin 205 comprises the first secondary coil 230 and the second secondary coil 235 (e.g. the first secondary coil 230 and the second secondary coil 235 overlap at a cross-sectional interface (typically, the cross-sectional interface may occur at a pre-determined/pre-defined winding slope)). In the exemplary embodiment of FIG. 2A, the primary coil 210 is wound/wrapped (e.g. uniformly) around the total winding length (e.g. the first, second, and third winding lengths) of the bobbin 205. Additionally, in the exemplary embodiment of FIG. 2A, the two secondary coils 230, 235 are wound/wrapped around/on top of at least a portion of the primary coil 210.

In the exemplary embodiment of FIG. 2A, the first secondary coil 230 is wound across the first winding length 261 and the second winding length 262 of the bobbin 205. Typically, the first secondary coil 230 may be wound to an equal outer diameter for the first winding length 261 of the bobbin 205 as shown in the embodiment of FIG. 2A. Additionally, in the exemplary embodiment of FIG. 2A, the first winding length 261 of the bobbin 205 does not comprise the second secondary coil 235. In the exemplary embodiment of FIG. 2A, for the second winding length 262 of the bobbin 205, the first secondary coil 230 is wound in a tapering manner (e.g. the number of turns of the first secondary coil 230 proportionally decrease going from one end (e.g. closest to the first winding length 261) of the second winding length 262 to the other end (e.g. closest to the third winding length 263) of the second winding length 262). Additionally, it is important to note that the first secondary coil 230 may comprise a continuous conductive wire. In other words, the first secondary coil 230 may be wound from the first winding length 261 of the bobbin 205 to the second winding length 262 of the bobbin 205 (or vice versa) with one continuous wire (as shown in the embodiment of FIG. 2A).

In the exemplary embodiment of FIG. 2A, the second secondary coil 235 is wound in a similar manner as the first secondary coil 230. Typically, the second secondary coil 235 may be wound opposite/complementary to the first secondary coil 230. Typically, for the third winding length 263 of the bobbin 205, the second secondary coil 235 may be wound to an equal outer diameter as shown in the embodiment of FIG. 2A. Additionally, as shown in the exemplary embodiment of FIG. 2A, within the third winding length 263, only the second secondary coil 235 is wound around the primary coil (in other words, in some embodiments, the third winding length 263 may not comprise the first secondary coil 230). Generally, the second secondary coil 235 may complement and be coiled in the opposite direction to the first secondary coil 230 (for example, to maintain the symmetrical (e.g. mirror) nature of the LVDT 200; in other words, to keep the "null point" (i.e. the zero output voltage point) of the moveable core 240 to be physically centered). For some embodiments, in the second winding length 232 of the bobbin 205, the second secondary coil winding 235 may interface with the first secondary coil winding 230 but not the primary coil winding 210 (leading to a symmetric winding pattern). Additionally, it is important to note that the second secondary coil winding 235 may comprise a continuous conductive wire. In other words, the second secondary coil winding 235 may be wound from the third winding length 263 to the second winding length 262 (or vice versa) with one continuous wire (as shown in the embodiment of FIG. 2A).

Figure 2B:
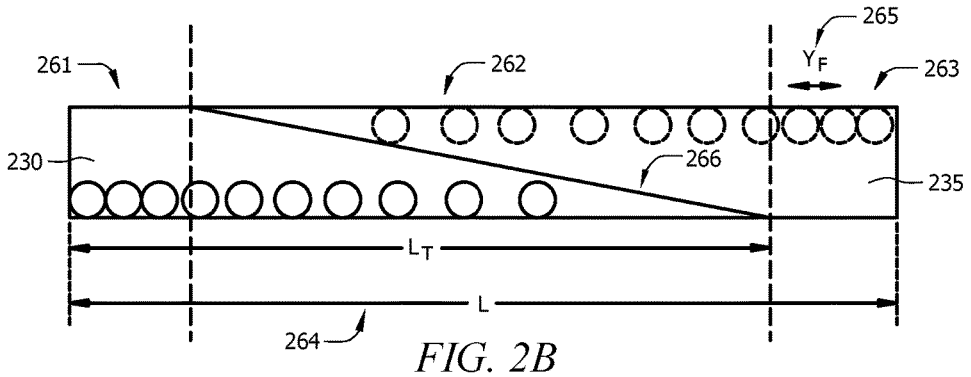
FIG. 2B illustrates an exploded cross-sectional view of two exemplary secondary coil windings of an exemplary embodiment of a LVDT (similar to the two secondary coil windings of the exemplary embodiment shown in FIG. 2A)

FIG. 2B illustrates an exploded cross-sectional view of two exemplary secondary coil windings 230, 235 of an exemplary embodiment of a LVDT (similar to the two secondary coil windings of the exemplary embodiment shown in FIG. 2A). In the exemplary embodiment of FIG. 2B, the secondary coil windings 230, 235 are wound in a tapering manner (e.g. the number of turns of the first secondary coil windings 230 and the second secondary coil windings 235 may proportionally decrease going from one end of the second winding length 262 to the other end of the second winding length 262). In the exemplary embodiment of FIG. 2B, the first secondary coil winding 230 is wound around the first winding length 261 and the second winding length 262, and the second secondary coil winding 235 is wound around the second winding length 262 and the third winding length 263. In this manner, the first secondary coil winding 230 and the second secondary coil winding 235 overlap at a cross-sectional interface 266 in the second winding length 262. In the exemplary embodiment of FIG. 2B, the first secondary coil winding 230 is wound opposite to the second secondary coil winding 235 (so that the total number of turns of coil/wire (e.g. the sum of the number of turns of the first secondary coil winding 230 and the number of turns of the second secondary coil winding 235) within each step is equal leading to an equal outer diameter across the length of the bobbin).

Additionally, in the exemplary embodiment of FIG. 2B, the secondary coils 230, 235 are wound with variable pitch windings (e.g. the distance between the turns of the secondary coils 230, 235 may vary (e.g. non-uniform)). In other words, the distance between the turns of the secondary coils 230, 235 (e.g. segment pitch) may increase as the secondary coils 230, 235 become more tapered. In the embodiment of FIG. 2B, the first segment pitch 265 is labelled as $Y_F$. Each consecutive segment pitch is shown to generally increase as the windings reach the center of the bobbin in the embodiment of FIG. 2B. Additionally, in the embodiment of FIG. 2B, the total winding length (L) 264 and the target winding length ($L_T$) are labelled. Generally, the total winding length 264 and the target winding length may be found using Eq. 5 and Eq. 6, respectively, as discussed previously.

Figure 3A:
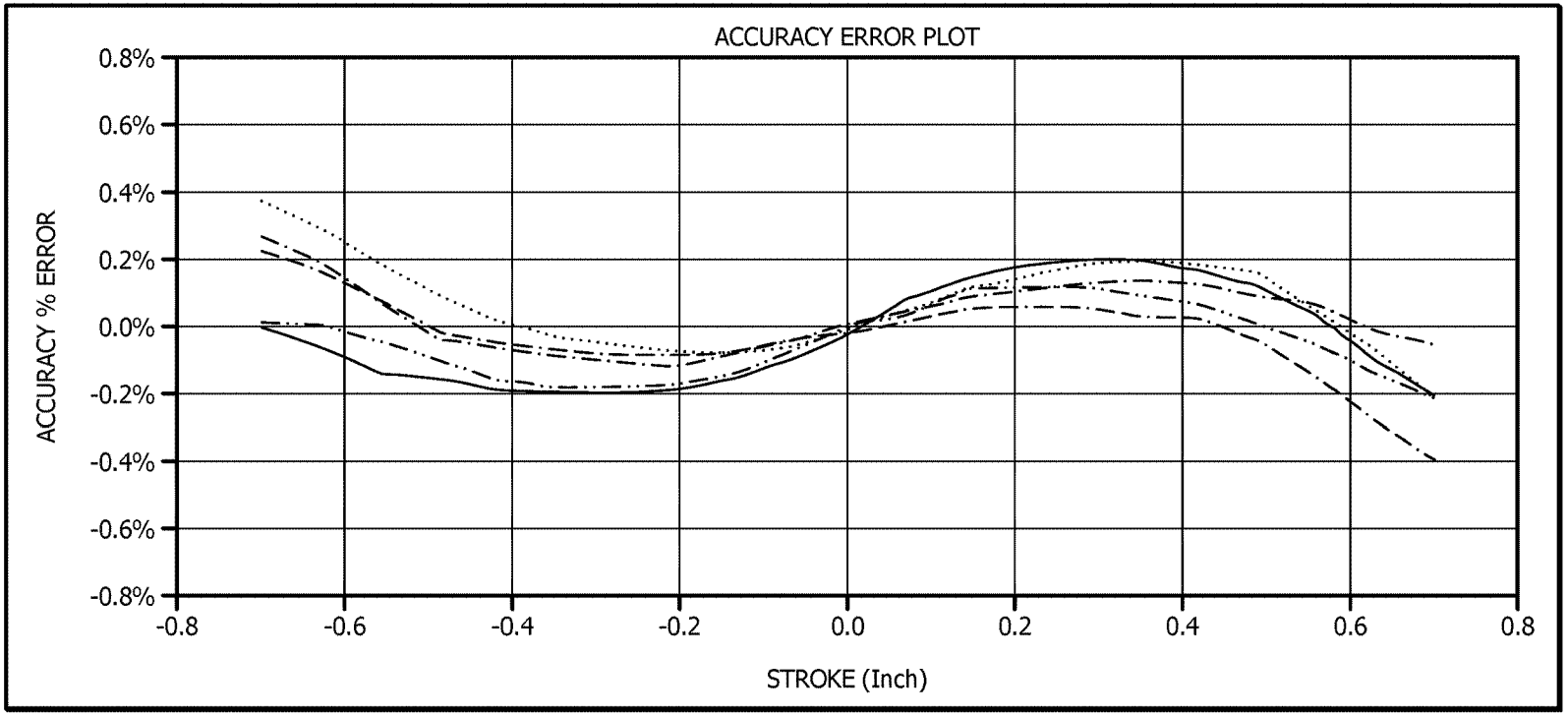
FIG. 3A illustrates a graph of accuracy error versus stroke for a LVDT comprising one primary coil winding, two tuning coil windings, and two secondary coil windings.
Figure 3B:
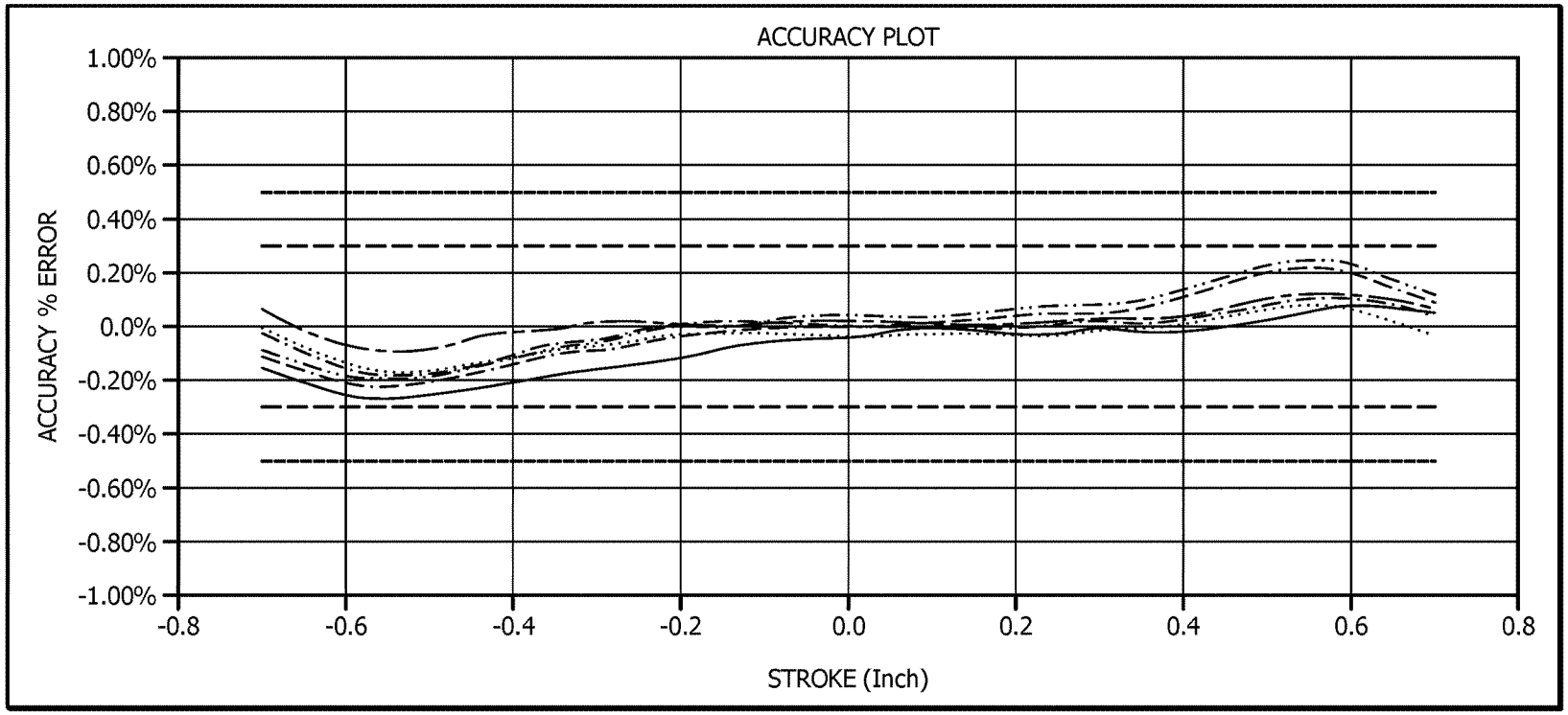
FIG. 3B illustrates a graph of accuracy error versus stroke for a LVDT comprising one primary coil winding and two secondary coil windings having fractional winding.

FIG. 3A and FIG. 3B illustrate a graph of the accuracy error versus stroke length (inches) for a LVDT comprising tuning coil windings (similar to the exemplary embodiment shown in FIG. 1) and for a LVDT comprising fractional windings (similar to the exemplary embodiment shown in FIG. 2A), respectively. Tests were performed using LVDT prototype(s) to illustrate the results shown in FIG. 3A and FIG. 3B. Generally, in the LVDT embodiment comprising tuning coil windings, a greater part to part variation results in higher tracking error. In the exemplary graph shown in FIG. 3A, the tracking error may be more clearly seen as the moveable core is located towards the ends of the bobbin (e.g. −0.7 inches and 0.7 inches). At the greatest stroke length, the tuning coil windings may lose the most accuracy. In the exemplary graph shown in FIG. 3A, the LVDT with the tuning coil windings is shown to have an accuracy error (%) range from approximately −0.4% to 0.4%. Generally, in the LVDT embodiment comprising fractional winding, a lower part to part variation results in less tracking error. In the exemplary graph shown in FIG. 3B, the tracking error may be more clearly seen as the moveable core is located towards the ends of the bobbin (e.g. −0.7 inches and 0.7 inches). At the greatest stroke length, the LVDT may lose the most accuracy. In the exemplary graph shown in FIG. 3B, the LVDT with fractional winding is shown to have an accuracy error (%) range from approximately −0.3% to 0.3%. Additionally, it is important to note that a flatter accuracy error plot generally indicates a greater level of accuracy. When comparing FIG. 3A and FIG. 3B, it may be seen that the LVDT comprising fractional winding (data shown in the exemplary graph of FIG. 3B) performs more accurately than the LVDT comprising tuning coil windings (data shown in the exemplary graph of FIG. 3A).

Figure 4A:
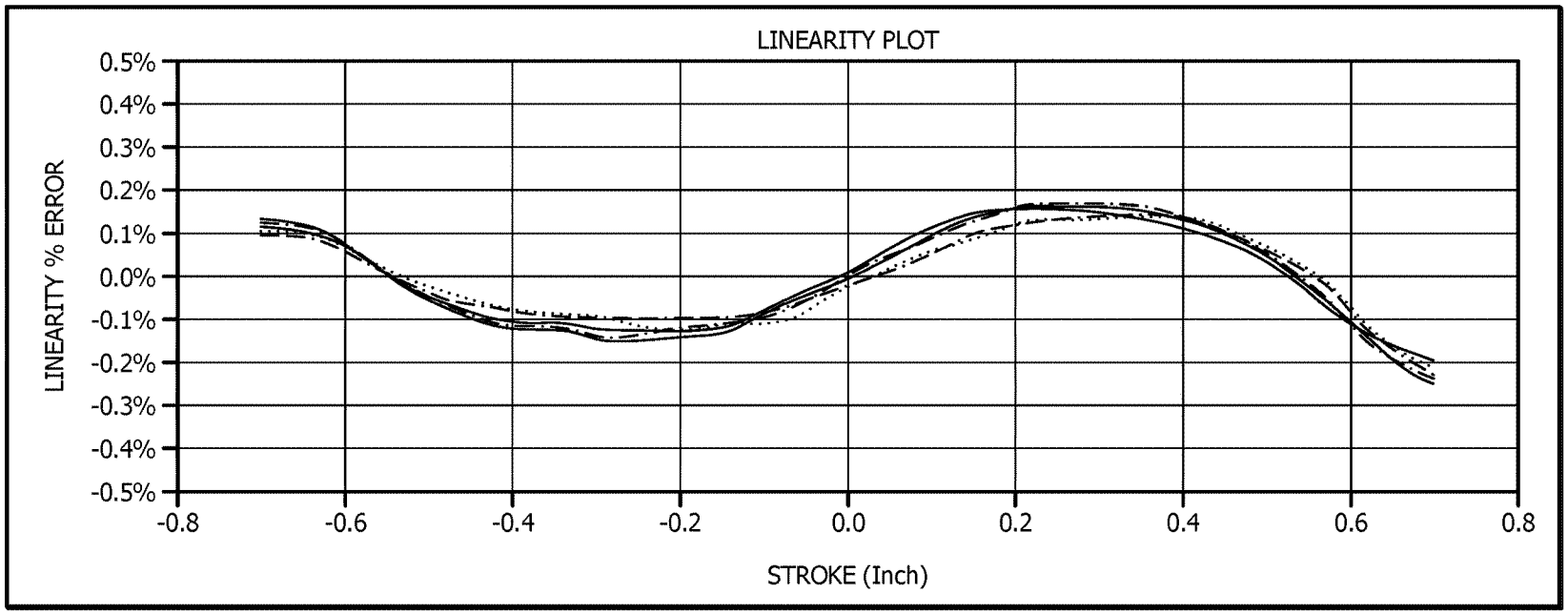
FIG. 4A illustrates a graph of linearity error versus stroke for a LVDT comprising one primary coil winding, two tuning coil windings, and two secondary coil windings.
Figure 4B:
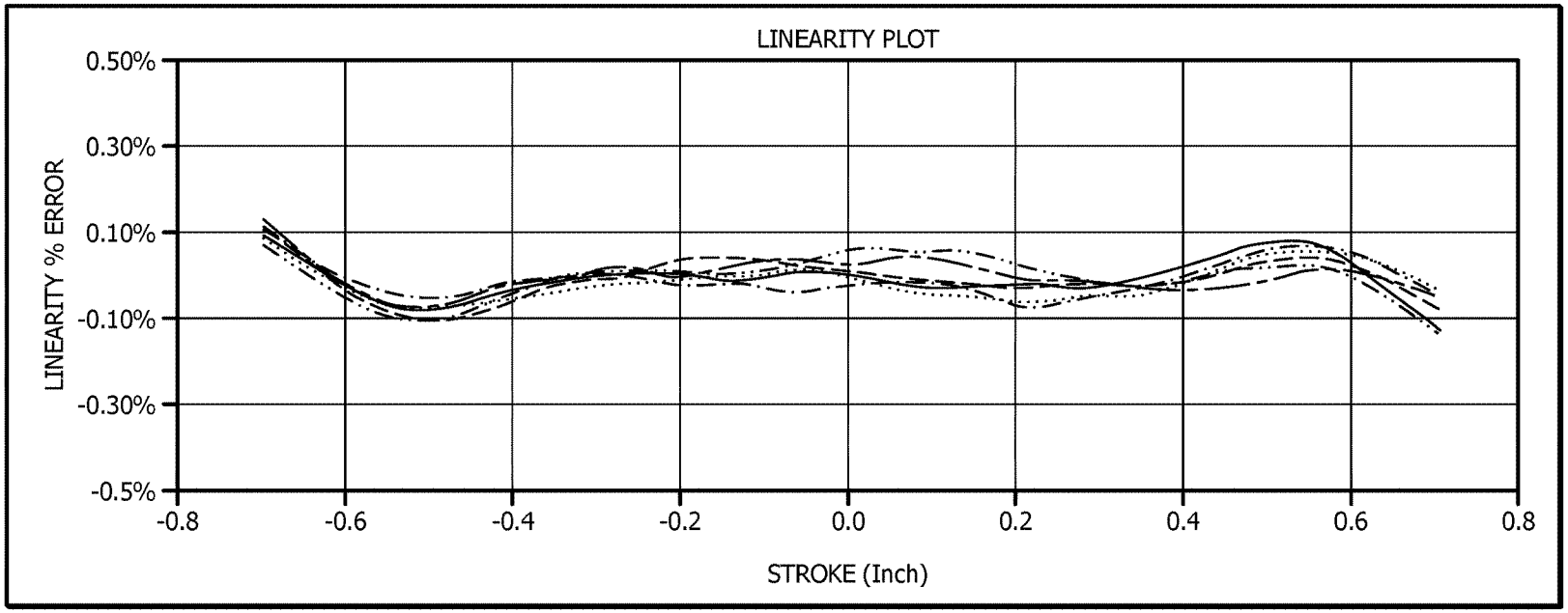
FIG. 4B illustrates a graph of linearity error versus stroke for a LVDT comprising one primary coil winding and two secondary coil windings having fractional winding.

FIG. 4A and FIG. 4B illustrate a graph of the linearity error versus the stroke length (inches) for a LVDT comprising tuning coil windings (similar to the exemplary embodiment shown in FIG. 1) and a LVDT comprising fractional windings (similar to the exemplary embodiment shown in FIG. 2A), respectively. Tests were performed using LVDT prototype(s) to illustrate the results shown in FIG. 4A and FIG. 4B. In the exemplary graph shown in FIG. 4A, the linearity error of the LVDT prototype comprising tuning coil windings is shown to be approximately 0.25%. Additionally, the Applicants performed a magnetic analysis test on an LVDT design comprising tuning coil windings (similar to the LVDT prototype used to gather the data illustrated in FIG. 4A) using a FEA based magnetic simulation software and found the linearity error to be approximately 0.045%. In the exemplary graph shown in FIG. 4B, the linearity error of the LVDT prototype comprising fractional coil windings is shown to be approximately 0.12%. A magnetic analysis test on an LVDT design comprising fractional windings (similar to the LVDT prototype used to gather the data illustrated in FIG. 4B) using a FEA based magnetic simulation software revealed the linearity error to be approximately 0.08%. By comparing the data presented in FIG. 4A and FIG. 4B, it can be seen that the linearity error is reduced by approximately 45% when implementing the LVDT comprising the fractional winding technique rather than the LVDT comprising tuning coil windings. Additionally, it was determined that there is a lower sensitivity deviation between the simulation data and the test data for the LVDT comprising fractional windings. In other words, the test data matched more closely with the simulation data for the LVDT comprising fractional windings than for the LVDT comprising tuning coil windings.

Having described device embodiments above, especially with regard to the figures, various additional embodiments can include, but are not limited to the following:

In a first embodiment, a linear variable displacement transformer (LVDT) comprising: a bobbin; a moveable core (operable to fit within an opening in the bobbin and move with respect to the bobbin); a primary coil of wire (wound on the bobbin); two secondary coils of wire (wound on the bobbin about the primary coil); wherein: a first secondary coil of the two secondary coils of wire is wound around a first winding length of the bobbin; the first secondary coil and a second secondary coil of the two secondary coils of wire overlap over a second winding length of the bobbin; and the second secondary coil is wound around a third winding length of the bobbin. A second embodiment can include the LVDT of the first embodiment, wherein the first winding length is located near a first end of the bobbin, wherein the third winding length is located near a second end of the bobbin, and wherein the second winding length is located between the first winding length and the third winding length. A third embodiment can include the LVDT of the first to second embodiments, wherein the first winding length is equal in length to the third winding length. A fourth embodiment can include the LVDT of the first to third embodiments, wherein the primary coil is wound uniformly (e.g. equal spacing or no spacing between the coils) around the total winding length of the bobbin (to achieve a pre-determined portion of the outer diameter), and wherein the total winding length of the bobbin comprises the first winding length, the second winding length, and the third winding length. A fifth embodiment can include the LVDT of the first to fourth embodiments, wherein (at least a portion of) the primary coil of wire interfaces with the outer surface of the bobbin, and wherein the primary coil of wire comprises a portion of the (pre-determined) outer diameter of the LVDT. A sixth embodiment can include the LVDT of the first to fifth embodiments, wherein the primary coil of wire comprises a single piece of wire; wherein the primary coil of wire begins winding from a first end of the winding length, proceeds to a second end of the winding length, and then changes directions and winds back to the first end of the winding length. A seventh embodiment can include the LVDT of the first to sixth embodiments, wherein the winding process continues until a pre-determined portion of the outer diameter is achieved by the primary coil of wire. An eighth embodiment can include the LVDT of the first to seventh embodiments, wherein at least a portion of the two secondary coils of wire interface with the primary coil of wire. A ninth embodiment can include the LVDT of the first to eighth embodiments, wherein each of the two secondary coils of wire comprise a single piece of wire, wherein the two secondary coils of wire are wound complimentary to each other, and wherein the first secondary coil of wire begins winding from the first end of the bobbin towards the second end of the bobbin and the second secondary coil of wire begins winding from the second end of the bobbin towards the first end of the bobbin. A tenth embodiment can include the LVDT of the first to ninth embodiments, wherein the two secondary coils of wire are wound at varying segment pitches/intervals of space with respect to the turns of coil. An eleventh embodiment can include the LVDT of the first to tenth embodiments, wherein for each of the two secondary coils of wire, the first segment pitch is less than the second segment pitch, the second segment pitch is less than the third segment pitch, the third segment pitch is less than the fourth segment pitch, etc. A twelfth embodiment can include the LVDT of the first to eleventh embodiments, wherein the two secondary coils of wire are wound at uniform segment pitches/intervals of space with respect to the turns of coil. A thirteenth embodiment can include the LVDT of the first to twelfth embodiments, wherein the first secondary coil windings and the second secondary coil windings are configured to be asymmetric (e.g. not mirrored) with respect to the longitudinal axis of the bobbin. A fourteenth embodiment can include the LVDT of the first to thirteenth embodiments, wherein the first secondary coil windings and the second secondary coil windings are configured to be symmetric (e.g. mirrored) with respect to the longitudinal axis of the bobbin. A fifteenth embodiment can include the LVDT of the first to fourteenth embodiments, wherein the first secondary coil of wire is wound complementary to the second secondary coil of wire to overlap at a cross-sectional interface across the second winding length. A sixteenth embodiment can include the LVDT of the first to fifteenth embodiments, wherein the cross-sectional interface is approximately linear, and wherein the cross-sectional interface is configured to approximately achieve a pre-determined/pre-defined winding slope. A seventeenth embodiment can include the LVDT of the first to sixteenth embodiments, wherein the pre-determined/pre-defined winding slope is inversely related to the first segment pitch and the winding space. An eighteenth embodiment can include the LVDT of the first to seventeenth embodiments, wherein in the first winding length, the first secondary coil is wound uniformly (on top of the primary coil of wire) to achieve a pre-determined outer diameter of the LVDT, and wherein in the third winding length, the second secondary coil of wire is wound uniformly (on top of the primary coil of wire) to achieve the pre-determined outer diameter of the LVDT. A nineteenth embodiment can include the LVDT of the first to eighteenth embodiments, wherein the primary coil of wire and the two secondary coils of wire are wound around the bobbin to achieve a uniform outer diameter (across the winding length of the bobbin). A twentieth embodiment can include the LVDT of the first to nineteenth embodiments, wherein the two secondary coils of wire are wound around the bobbin for an equal number of turns, wherein the two secondary coils of wire are wound in opposite directions (e.g. first secondary coil wound left to right and second secondary coil wound right to left). A twenty-first embodiment can include the LVDT of the first to twentieth embodiments, wherein the moveable core comprises a material that has a relatively high magnetic permeability (such as ferro-magnetic materials (e.g. alloys of iron, nickel, cobalt, manganese, chromium, molybdenum, permalloy, mu-metal, or combinations thereof)). A twenty-second embodiment can include the LVDT of the first to twenty-first embodiments, wherein the moveable core couples the magnetic field generated by the primary coil of wire into the two secondary coils of wire differentially based on a location of the moveable core. A twenty-third embodiment can include the LVDT of the first to twenty-second embodiments, wherein the magnetic field is generated by the primary coil of wire when it is excited by an alternating current (AC) voltage. A twenty-fourth embodiment can include the LVDT of the first to twenty-third embodiments, wherein the total winding length is the sum of the length of the moveable coil and the moveable coil's full-scale stroke. A twenty-fifth embodiment can include the LVDT of the first to twenty-fourth embodiments, wherein the sum of the first winding length and the second winding length comprises the target winding length for the first secondary coil, wherein the sum of the second winding length and the third winding length comprises the target winding length of the second secondary coil, and wherein the target winding length for the first secondary coil and the second secondary coil is determined by the following equation: $L_T=k/(D_M*S_T)$, where $D_M$ is the diameter of the secondary coil, $S_T$ is the target sensitivity of the LVDT (pre-determined based on type of application), and k is a drive constant. A twenty-sixth embodiment can include the LVDT of the first to twenty-fifth embodiments, wherein the sensitivity of the LVDT is proportional to the winding slope. A twenty-seventh embodiment can include the LVDT of the first to twenty-sixth embodiments, wherein a high sensitivity LVDT is configured to have a winding length less than the winding space available, and wherein the winding space available is configured to be the sum of the moveable core and its full-scale stroke.

Exemplary embodiments might also relate to a method for determining a position using a linear variable differential transformer (LVDT) (e.g. similar to those described above, which may be considered optionally incorporated herein with respect to the discussion of the system). Such method embodiments, for example, might include, but are not limited to, the following:

In a twenty-eighth embodiment a method for determining a position using a linear variable differential transformer (LVDT), the method comprising: moving a moveable core within a bobbin; and providing an output voltage from the LVDT; wherein: the output voltage is indicative of a position of the moveable core in the bobbin; and the LVDT comprises: the bobbin; the moveable core (operable to fit within an opening in the bobbin and move with respect to the bobbin); a primary coil of wire (wound on the bobbin); two secondary coils of wire (wound on the bobbin about the primary coil); wherein: a first secondary coil of the two secondary coils of wire is wound around a first winding length of the bobbin; the first secondary coil and a second secondary coil of the two secondary coils of wire overlap over a second winding length of the bobbin; and the second secondary coil is wound around a third winding length of the bobbin. A twenty-ninth embodiment can include the method of the twenty-eighth embodiment, wherein the first winding length is located near a first end of the bobbin, wherein the third winding length is located near a second end of the bobbin, and wherein the second winding length is located between the first winding length and the third winding length. A thirtieth embodiment can include the method of the twenty-eight to twenty-ninth embodiments, wherein the first winding length is equal in length to the third winding length. A thirty-first embodiment can include the method of the twenty-eight to thirtieth embodiments, wherein the primary coil is wound uniformly (e.g. equal spacing or no spacing between the coils) around the total winding length of the bobbin (to achieve a pre-determined portion of the outer diameter), and wherein the total winding length of the bobbin comprises the first winding length, the second winding length, and the third winding length. A thirty-second embodiment can include the method of the twenty-eighth to thirty-first embodiments, wherein (at least a portion of) the primary coil of wire interfaces with the outer surface of the bobbin, and wherein the primary coil of wire comprises a portion of the (pre-determined) outer diameter of the LVDT. A thirty-third embodiment can include the method of the twenty-eighth to thirty-second embodiments, wherein the primary coil of wire comprises a single piece of wire; wherein the primary coil of wire begins winding from a first end of the winding length, proceeds to a second end of the winding length, and then changes directions and winds back to the first end of the winding length. A thirty-fourth embodiment can include the method of the twenty-eighth to thirty-third embodiments, wherein this winding process continues until a pre-determined portion of the outer diameter is achieved by the primary coil of wire. A thirty-fifth embodiment can include the method of the twenty-eighth to thirty-fourth embodiments, wherein at least a portion of the two secondary coils of wire interface with the primary coil of wire. A thirty-sixth embodiment can include the method of the twenty-eighth to thirty-fifth embodiments, wherein each of the two secondary coils of wire comprise a single piece of wire, wherein the two secondary coils of wire are wound complimentary to each other, and wherein the first secondary coil of wire begins winding from the first end of the bobbin towards the second end of the bobbin and the second secondary coil of wire begins winding from the second end of the bobbin towards the first end of the bobbin. A thirty-seventh embodiment can include the method of the twenty-eighth to thirty-sixth embodiments, wherein the two secondary coils of wire are wound at varying segment pitches/intervals of space with respect to the turns of coil. A thirty-eighth embodiment can include the method of the twenty-eighth to thirty-seventh embodiments, wherein for each of the two secondary coils of wire, the first segment pitch is less than the second segment pitch, the second segment pitch is less than the third segment pitch, the third segment pitch is less than the fourth segment pitch, etc. A thirty-ninth embodiment can include the method of the twenty-eighth to thirty-eighth embodiments, wherein the two secondary coils of wire are wound at uniform segment pitches/intervals of space with respect to the turns of coil. A fortieth embodiment can include the method of the twenty-eighth to thirty-ninth embodiments, wherein the first secondary coil windings and the second secondary coil windings are configured to be asymmetric (e.g. not mirrored)

with respect to the longitudinal axis of the bobbin. A forty-first embodiment can include the method of the twenty-eighth to fortieth embodiments, wherein the first secondary coil windings and the second secondary coil windings are configured to be symmetric (e.g. mirrored) with respect to the longitudinal axis of the bobbin. A forty-second embodiment can include the method of the twenty-eighth to forty-first embodiments, wherein the first secondary coil of wire is wound complementary to the second secondary coil of wire to overlap at a cross-sectional interface across the second winding length. A forty-third embodiment can include the method of the twenty-eighth to forty-second embodiments, wherein the cross-sectional interface is approximately linear, and wherein the cross-sectional interface is configured to approximately achieve a pre-determined/pre-defined winding slope. A forty-fourth embodiment can include the method of the twenty-eighth to forty-third embodiments, wherein the pre-determined/pre-defined winding slope is inversely related to the first segment pitch and the winding space. A forty-fifth embodiment can include the method of the twenty-eighth to forty-fourth embodiments, wherein in the first winding length, the first secondary coil is wound uniformly (on top of the primary coil of wire) to achieve a pre-determined outer diameter of the LVDT, and wherein in the third winding length, the second secondary coil of wire is wound uniformly (on top of the primary coil of wire) to achieve the pre-determined outer diameter of the LVDT. A forty-sixth embodiment can include the method of the twenty-eighth to forty-fifth embodiments, wherein the primary coil of wire and the two secondary coils of wire are wound around the bobbin to achieve a uniform outer diameter (across the winding length of the bobbin). A forty-seventh embodiment can include the method of the twenty-eighth to forty-sixth embodiments, wherein the two secondary coils of wire are wound around the bobbin for an equal number of turns, wherein the two secondary coils of wire are wound in opposite directions (e.g. first secondary coil wound left to right and second secondary coil wound right to left). A forty-eighth embodiment can include the method of the twenty-eighth to forty-seventh embodiments, wherein the moveable core comprises a material that has a relatively high magnetic permeability (such as ferro-magnetic materials (e.g. alloys of iron, nickel, cobalt, manganese, chromium, molybdenum, permalloy, mu-metal, or combinations thereof)). A forty-ninth embodiment can include the method of the twenty-eighth to forty-eighth embodiments, wherein the moveable core couples the magnetic field generated by the primary coil of wire into the two secondary coils of wire differentially based on a location of the moveable core. A fiftieth embodiment can include the method of the twenty-eighth to forty-ninth embodiments, wherein the magnetic field is generated by the primary coil of wire when it is excited by an alternating current (AC) voltage. A fifty-first embodiment can include the method of the twenty-eighth to fiftieth embodiments, wherein the total winding length is the sum of the length of the moveable coil and the moveable coil's full-scale stroke. A fifty-second embodiment can include the method of the twenty-eighth to fifty-first embodiments, wherein the sum of the first winding length and the second winding length comprises the target winding length for the first secondary coil, wherein the sum of the second winding length and the third winding length comprises the target winding length of the second secondary coil, and wherein the target winding length for the first secondary coil and the second secondary coil is determined by the following equation: $L_T=k/(D_M*S_T)$, where $D_M$ is the diameter of the secondary coil, $S_T$ is the target sensitivity of the LVDT (pre-determined based on type of application), and k is a drive constant. A fifty-third embodiment can include the method of the twenty-eighth to fifty-second embodiments, wherein the sensitivity of the LVDT is proportional to the winding slope. A fifty-fourth embodiment can include the method of the twenty-eighth to fifty-third embodiments, wherein a high sensitivity LVDT is configured to have a winding length less than the winding space available, and wherein the winding space available is configured to be the sum of the moveable core and its full-scale stroke.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification, and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system, or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A linear variable displacement transformer (LVDT) comprising:

a bobbin;

a moveable core;

a primary coil of wire;

two secondary coils of wire;

wherein:

a first secondary coil of the two secondary coils of wire is wound around a first winding length of the bobbin;

the first secondary coil and a second secondary coil of the two secondary coils of wire overlap over a second winding length of the bobbin, such that the first secondary coil extends only along the first and second winding lengths of the bobbin;

the second secondary coil is wound around a third winding length of the bobbin, such that the second secondary coil extends only along the second and third winding lengths of the bobbin; and, the first, second, and third winding lengths are non-overlapping.

2. The LVDT of claim 1, wherein the first winding length is located near a first end of the bobbin, wherein the third winding length is located near a second end of the bobbin, wherein the second winding length is located between the first winding length and the third winding length, and wherein the first winding length is equal in length to the third winding length.

3. The LVDT of claim 2, wherein the second winding length is a fraction of the total winding length of the primary coil of wire, and wherein the fraction is configured to produce a linear output across the total winding length of the LVDT.

4. The LVDT of claim 1, wherein the primary coil of wire is wound uniformly around the total winding length of the bobbin, and wherein the total winding length of the bobbin comprises the first winding length, the second winding length, and the third winding length.

5. The LVDT of claim 4, wherein at least a portion of the primary coil of wire interfaces with the outer surface of the bobbin, and wherein the primary coil of wire comprises a portion of the outer diameter of the LVDT.

6. The LVDT of claim 4, wherein the primary coil of wire comprises a single piece of wire; wherein the primary coil of wire begins winding from a first end of the total winding length, proceeds to a second end of the total winding length, and then changes directions and winds back to the first end of the total winding length.

7. The LVDT of claim 6, wherein this winding process continues until a pre-determined portion of the outer diameter is achieved by the primary coil of wire.

8. The LVDT of claim 1, wherein at least a portion of the two secondary coils of wire interface with the primary coil of wire.

9. The LVDT of claim 8, wherein each of the two secondary coils of wire comprises a single piece of wire, wherein the two secondary coils of wire are wound complimentary to each other, wherein the first secondary coil of wire begins winding from the first end of the bobbin towards the second end of the bobbin and the second secondary coil of wire begins winding from the second end of the bobbin towards the first end of the bobbin, and wherein the two secondary coils of wire are wound around the bobbin for an equal number of turns.

10. The LVDT of claim 9, wherein the two secondary coils of wire are wound at varying segment pitches with respect to the turns of coil.

11. The LVDT of claim 10, wherein for each of the two secondary coils of wire, each consecutive segment pitch increases linearly.

12. The LVDT of claim 9, wherein the two secondary coils of wire are wound at uniform segment pitches with respect to the turns of coil.

13. The LVDT of claim 9, wherein the windings of the first secondary coil of wire and the windings of the second secondary coil of wire are configured to be symmetric with respect to the longitudinal axis of the bobbin.

14. The LVDT of claim 1, wherein the first secondary coil of wire is wound complementary to the second secondary coil of wire to overlap at a cross-sectional interface across the second winding length.

15. The LVDT of claim 9, wherein in the first winding length, the first secondary coil of wire is wound uniformly to achieve a pre-determined outer diameter of the LVDT, and wherein in the third winding length, the second secondary coil of wire is wound uniformly to achieve the pre-determined outer diameter of the LVDT.

16. The LVDT of claim 14, wherein the cross-sectional interface is configured to approximately achieve a pre-determined/pre-defined winding slope, and wherein the pre-determined/pre-defined winding slope is inversely related to the first segment pitch of the secondary coils of wire and the total winding length.

17. The LVDT of claim 1, wherein the moveable core comprises a material that has a relatively high magnetic permeability.

18. The LVDT of claim 17, wherein the moveable core couples the magnetic field generated by the primary coil of wire into the two secondary coils of wire differentially based on a location of the moveable core.

19. The LVDT of claim 18, wherein the magnetic field is generated by the primary coil of wire when it is excited by an alternating current (AC) voltage.

* * * * *